US012623761B2

(12) United States Patent
Baffigo et al.

(10) Patent No.: US 12,623,761 B2
(45) Date of Patent: May 12, 2026

(54) PROPELLER WITH FOLDING BLADES AND PROPULSION SYSTEM

(71) Applicant: VELETTRICA S.R.L., Rome (IT)

(72) Inventors: Roberto Baffigo, Rome (IT); Paolo Bellomi, Rome (IT)

(73) Assignee: VELETTRICA S.R.L., Rome (IT)

( * ) Notice: Subject to any disclaimer, the term of this patent is extended or adjusted under 35 U.S.C. 154(b) by 0 days.

(21) Appl. No.: 18/847,972

(22) PCT Filed: Mar. 17, 2023

(86) PCT No.: PCT/IB2023/052632
§ 371 (c)(1),
(2) Date: Sep. 17, 2024

(87) PCT Pub. No.: WO2023/180889
PCT Pub. Date: Sep. 28, 2023

(65) Prior Publication Data

US 2025/0196982 A1 Jun. 19, 2025

(30) Foreign Application Priority Data

Mar. 23, 2022 (IT) ..... 102022000005693

(51) Int. Cl.
*B63H 1/22* (2006.01)
*B63H 3/04* (2006.01)

(52) U.S. Cl.
CPC ..... *B63H 1/22* (2013.01); *B63H 3/04* (2013.01)

(58) Field of Classification Search
CPC ..... B63H 1/22; B63H 3/04
See application file for complete search history.

(56) References Cited

U.S. PATENT DOCUMENTS 3,709,634 A * 1/1973 Lorenz ..... B63H 1/22 416/142
4,086,025 A 4/1978 Astrand
(Continued)

FOREIGN PATENT DOCUMENTS

DK 179125 B1 11/2017
EP 3904200 A1 11/2021
(Continued)

OTHER PUBLICATIONS

ISA/EP, "International Search Report and Written Opinion", mailed Jul. 5, 2023, corresponding to PCT International Application No. PCT/IB2023/052632, 8 pages.

*Primary Examiner* — Courtney D Heinle
*Assistant Examiner* — Danielle M. Christensen
(74) *Attorney, Agent, or Firm* — Lucas & Mercanti, LLP

(57) ABSTRACT

A propeller with folding blades for the propulsion of a mobile vehicle inside a fluid is provided having a movement mechanism rotatable around a central rotation axis of the propeller; and a plurality of blades. Each blade has a root end connected to the movement mechanism by a gear to allow the movement of the blade from an opening position to a closed position and vice versa, wherein in the closed position the plurality of blades are configured to form a continuous solid in the form of a spindle wherein a leading edge of a first blade (S') is configured to osculate a trailing edge of a second blade following the first blade (S') in such a way as to form a continuous surface between the first blade (S') and the second blade (S").

11 Claims, 12 Drawing Sheets

(56) References Cited

U.S. PATENT DOCUMENTS

| | | | | |
|---|---|---|---|---|
| 4,364,711 | A * | 12/1982 | Brandt | B63H 1/24 416/212 R |
| 6,371,726 | B1 * | 4/2002 | Jonsson | B63H 1/24 416/142 |
| 7,597,597 | B2 * | 10/2009 | Oishi | B63H 20/007 440/6 |
| 2008/0047926 | A1 | 2/2008 | Santini et al. | |

FOREIGN PATENT DOCUMENTS

| | | | |
|---|---|---|---|
| FR | 3017597 | A1 | 8/2015 |
| IT | MI990864 | A1 | 10/2000 |
| WO | 95/17331 | A1 | 6/1995 |

* cited by examiner

PROPELLER WITH FOLDING BLADES AND PROPULSION SYSTEM

CROSS-REFERENCE TO RELATED APPLICATIONS

This application is a 371 national phase entry of PCT/IB2023/052632, filed Mar. 17, 2023, which claims the benefit of Italian Patent Application No. 102022000005693, filed Mar. 23, 2022.

FIELD OF THE INVENTION

The present invention relates to a propeller with folding blades for the propulsion of a mobile vehicle within a fluid. Furthermore, the present invention relates to a propulsion system and a mobile vehicle comprising said propeller. In addition, the present invention relates to a method for making the blade and a method for defining the rotation axis of the blade.

BACKGROUND OF THE INVENTION

The use of the electric motor for marine propulsion has recently opened up new possibilities for propeller design. In fact, this is no longer dependent on the torque curves typical of diesel engines; there are also, at the same power output, almost infinite combinations of torque and rotational speeds.

The problem of battery life related to the low energy density of batteries compared to fuels reinforces the need to seek maximum efficiency in the propulsion system. In an electrical system, efficiency of the propeller is the key element for maximizing efficiency.

The propellers currently available, most of which are designed to be coupled to internal combustion engines, do not have excellent efficiency, since they are the result of a compromise between engine performance and a reduced drag.

In fact, simulations and tests show that for the typical speeds of a sailing propeller the most efficient propeller should be significantly larger (i.e. about twice the standard diameter), slower and with a higher pitch than those currently used. In particular, the most efficient propeller should have a significant elongation, a low ratio between expanded area and disc area and a pitch equal to the diameter, conditions poorly satisfied by the propellers normally used.

In addition, the high torque required by a propeller with a high pitch and diameter is incompatible with the curves of a diesel engine, unless using a speed reducer with a high reduction ratio that, however, introduces other performance, weight, cost and maintenance problems.

Even using an electric motor on the sailing vehicle, there are still problems to be solved in order to install a propeller with the above characteristics that are essentially linked to the sailing conditions.

In fact, for a sailing vehicle there are four different sailing conditions: forward, reverse, recharging of the accumulators during sailing and so-called "pure sailing".

In the forward driving condition (first condition), the ideal propeller should have high efficiency and good thrust when maneuvering or in a headwind.

In the reverse driving condition (second condition), the ideal propeller should have good thrust under all conditions.

The condition of recharging the accumulators during sailing (third condition) is possible using the electric motor as a generator. In this phase of sailing, the ideal propeller is the one that allows as much energy as possible to be produced without excessively slowing down the vehicle, i.e. one that has a high efficiency. However, since during recharging the angle of incidence of the blades with respect to the flow is reversed, it is necessary to adopt some solution to optimize the efficiency of the propeller in this phase without compromising this for the propulsion phase.

In the pure sailing condition (fourth condition), the propeller represents a parasitic resistance to the progression of the sailing vehicle. The solutions adopted so far include using a small propeller to reduce friction. However, this would result in poor propulsion performance and insufficient regeneration against a non-negligible residual friction. Another solution is to use propellers with blades that are completely without twist, that are flat and symmetrical with respect to the flow, and have automatic feathering. However, this would result in poor performance in propulsion and regeneration. A further solution is to use propellers with blades folding around a secant or twisting axis typically located at about 90 degrees relative to the axis of the propeller that open by centrifugal force or inertia. However, in this case, the shape of the blades is determined by a trade-off between efficiency in the open position and friction in the closed position. The centrifugal opening makes these propellers very inefficient in reverse and regeneration. Another solution is to use retractable systems. However, these systems are complex and expensive, require maintenance and take up a lot of space inside the boat.

Meeting all four of these conditions at the same time is complicated; the solutions adopted so far are compromises that do not allow optimisation of the performance of the propeller according to the criteria of the requirements.

In fact, according to the requirements, a propeller that maximizes the performance and thrust in the first and second conditions has a larger diameter and a greater twisting of the blades than those currently in use, and the solutions adopted so far do not allow lowering of the friction caused by blades with these characteristics during sailing.

Moreover, the propellers currently in use, in many cases, do not satisfy the third condition. One solution adopted is to turn the blades on their axis at an angle of about 180 degrees to present the concavity of the blade in the correct direction during recharging.

However, even this solution is not suitable for the use of propellers designed according to the criteria listed above.

In fact, as the diameter of the propeller increases with respect to that of the hub, the twisting increases, that is, the difference between the geometric pitch setting angle of the profile at the root of the blade compared to that at the apex of the blade. In addition, the twisting varies as the pitch varies and a propeller designed according to the requirements, with pitch P equal to or close to its diameter, is a propeller that has greater twisting or difference Δ between the geometric pitch setting angle at the apex and geometric pitch setting angle at the root of the blade. FIG. 12 shows the trend of the difference Δ between apex/root pitch setting angle as a function of pitch P for a propeller with a radius at the apex of 29 cm and at the root of 5.5 cm and a diameter of 58 cm. It should be noted that at the value of the diameter the difference Δ is a maximum, that is, the greatest twist is obtained.

Therefore, blades with high propulsive efficiency have a shape and dimensions such as to cause strong resistance even if feathered or folded with the geometries adopted and known in the literature. Conversely, blades designed to cause the least friction when feathered or folded may not exhibit the correct twist.

It should be noted that the option of adjusting the pitch of the propeller is an additional important requirement to make the propeller efficient in a wide spectrum of speeds and sailing conditions, that is, in those conditions in which the wind or the sea apply a positive or negative force to the boat with respect to the thrust of the propeller. It is known that in these conditions the optimal propeller must have a pitch respectively greater than or less than the ideal design pitch.

An optimal propeller for use on a sailing boat with electric or hybrid propulsion is a propeller that allows switching from sailing to electric, and vice versa, having a positive energy balance at the end of a normal sailing day without precluding pure sailing. These principles may be applied to vessels of all sizes for the propulsion of cargo or passenger ships where hybrid and wind propulsion are also included.

The known art for use in the conditions listed above includes propellers with folding blades, automatic or controlled variable pitch propellers, and retractable systems.

Document DK179125B1 describes for example a folding blade system in which each blade of a propeller is free to rotate within a certain angle with respect to the hub on an axis perpendicular to the axis of the propeller placed at a distance therefrom equal to about half the radius of the hub and perpendicular to the axis of the blade. The blades can be closed backwards during sailing due to the pressure exerted by the flow. During forward propulsion, the blades open by centrifugal force and remain in the correct position thanks to the pressure of the water they propel. During reversing, the blades open by centrifugal force, but this force is counteracted by the pressure in the opposite direction and therefore they cannot open completely; this affects the thrust. The system can be used in drag to produce energy during sailing but must reach a high number of revolutions for the blades to remain open. In practice, this results in a very low regeneration capacity. In addition, this mechanism is suitable for small propellers but does not solve the problem of friction when in the closed position if the blades are large and very twisted.

Document WO9517331A1 discloses a folding blade system that allows for two positions of the pitch.

Another solution with variable pitch is described in ITMI990864A1 which represents one of several solutions for self-feathering propellers. The propeller has blades that can rotate by a certain angle on an axis perpendicular to the propeller axis and coincident with the axis of the blade in such a way as to position themselves in a feathered position when no rotation is inscribed on the propeller axis. In case of rotation of the axis, the blades rotate on their axis up to the working position where they are stopped by a limit switch. The blades have one forward and one reverse position that can be used for recharging in drag. The blades are longitudinally symmetrical and free of twisting, so they cause low friction when feathered but have low efficiency in propulsion and regeneration.

EP3904200A1 discloses a solution with variable pitch propellers with mechanical or hydraulic control. The propeller provides an electromechanical system that allows the blades to rotate 360° with respect to their axis perpendicular to the propeller shaft. These blades can then be positioned with the concavity towards the stern for forward propulsion, towards the bow for regeneration and feathered for pure sailing. To have a good yield in propulsion and regeneration, the blades are concave and twisted. This results in residual friction when the blades are feathered. Therefore, compared to variations with twisting, the requirement of efficiency in thrust and regeneration is opposite to that of low friction if feathered, this prevents mounting longer blades with high twisting that would cause excessive parasitic resistance.

There are also retractable systems in the literature. These are, however, complex systems that take up a lot of space inside the vessel. In addition, fixed blade propellers are fitted in many cases, so the requirement of not taking up excessive space inside the hull is opposed to the requirement of a large diameter of the propeller to have thrust and regeneration performance. Due to the bulk, complexity and high cost, both initial and maintenance, these systems are usually only used on large luxury sailing yachts.

SUMMARY OF THE INVENTION

Therefore, an object of the present invention is to provide a propeller which partially or completely overcomes the drawbacks of the known art. In particular, it is an object of the present invention to obtain a propeller for nautical applications with high efficiency during thrusting or generating operations and low resistance when folded. In addition, it is an object of the present invention to obtain a drive and thrust or current generating system which is compact, economical and easy to maintain.

These objects are achieved by a propeller with folding blades, by a propulsion system, by a mobile vehicle, by a method for making the blade and by a method for defining the rotation axis of the blade according to the claims at the end of the present description.

In one aspect of the invention, there is provided a propeller with folding blades for propelling a mobile vehicle in a fluid, wherein the propeller comprises a movement mechanism rotatable around a central rotation axis of the propeller and a plurality of blades, wherein each blade comprises a root end connected to the movement mechanism via a gear to allow movement of said blade from an open position to a closed position and vice versa, wherein in the closed position the plurality of blades is configured to form a continuous solid in the form of a spindle wherein a leading edge of a first blade is configured to osculate a trailing edge of a second blade subsequent to the first blade so as to form a continuous surface between the first blade and the second blade.

The "spindle shape" is understood in this description—and according to the present invention—as the geometric shape of a solid, for example of a solid of rotation around the central rotation axis of the propeller, having a central bulge and a thinning at least one end. Thinning at one end means that the end of the solid formed by closing the blades tapers to form a pointed structure. In particular, in the closing position, the cross-section (i.e. the section normal to the rotation axis) of the solid formed by the blades—starting from the root end of each blade—initially increases until it reaches a maximum value at a central portion of said solid and then decreases at the opposite end of each blade. Specifically, at the end opposite the root end, the solid section is reduced uniformly in all directions with respect to the central rotation axis to form the tip. It should be noted in particular that the thinning does not cause any flattening of the solid but a roughly uniform narrowing towards the tip. The cross section of the spindle that is caused when closing the plurality of blades has an approximately circular profile. Therefore, the thinning towards the tip determines a progressive decrease in the radius of the circular section.

It can be seen that the continuous surface formed between the first blade and the second blade when the plurality of blades is in the closing position represents a surface portion of the spindle-shaped solid described above.

In another aspect of the invention, there is provided a propulsion system couplable to a mobile vehicle, wherein the system comprises at least one electric motor, at least one electric energy accumulator connected to the electric motor, at least one propeller as defined above, and a control unit connected to the electric motor and the propeller.

In a further aspect of the invention, there is provided a mobile vehicle, in particular a sailboat, comprising at least one propeller as defined above or comprising a propulsion system as defined above.

In a further aspect of the invention, there is provided a method of making a blade of a propeller as defined above, wherein the propeller comprises a radius and a diameter when the blades are in the open position and the blade comprises an apex end opposite the root end, wherein the method comprises:

- determining the diameter of the propeller and the pitch setting angles of the chords of the profiles for a predefined number of sections of the blade from the root end to the apex end;
- determining the length of the portion of a spindle from which the blades are intended to be obtained by subtracting the radius of the section on which the root end of the blades weighs from the radius of the propeller, wherein the desired expanded area for the propeller is approximately equal to the surface of the portion of the spindle used to obtain the blades, wherein the diameter and in part the shape of the spindle are determined by the measurement of said surface;
- positioning the blade sections on the spindle starting from the root end, wherein each section has the vertices of the chord lying on the normal circular section of the spindle corresponding to the blade section, wherein the length of the chord corresponds to that of the side of the regular polygon inscribed in this section having a number of sides equal to the desired number of blades and wherein each chord is rotated to have the correct relative pitch setting angle with respect to the base chord; and
- obtaining the shape of the blade by connecting the sections.

Through this method, it is possible to realize a plurality of blades and form a propeller as described above, wherein in the closed position the plurality of blades are configured to form a continuous spindle wherein a leading edge of a first blade is configured to osculate a trailing edge of a second blade following the first blade in such a way as to form a continuous surface between the first blade and the second blade.

In another aspect of the invention there is provided a method of defining the blade rotation axis of a propeller as defined above wherein the method comprises:

- positioning the blade in the opening position keeping a first end, in particular the end point, of the root chord fixed, the root chord being the chord at the root end;
- positioning a second end of said root chord equidistant with respect to the central axis of rotation of the propeller and with the correct pitch setting, and
- positioning the vertex at the apex end of the blade at the point of greatest distance from the central axis of rotation of the propeller, wherein the rotation axis of the blade is determined by the intersection of a first plane with a second plane, wherein the first plane is a plane passing through a first bisector relative to the angle whose vertex is the common terminal point of the root chords and the sides are the lines on which the chords of the root sections lie in the opening and closed position, and perpendicular to a first straight line passing through the first vertices of the two chords, and the second plane is a plane passing through a second bisector of the angle whose vertex is the end point of the root chords and the sides are the lines passing through the second vertices of the blade in the opening and closing position, and perpendicular to a second straight line passing through the second vertices of the blade in the opening and closed positions.

BRIEF DESCRIPTION OF THE DRAWINGS

These and other aspects of the present invention will become more apparent from the following disclosure of some preferred embodiments disclosed below.

DETAILED DESCRIPTION OF THE INVENTION

Figure 1B:
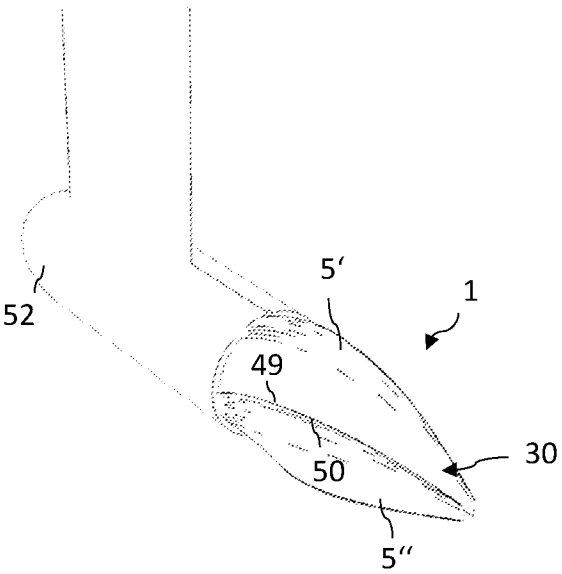
FIG. 1A-B show a representation of a propeller in a closed position and applied to a pod according to one example.
Figure 1A:
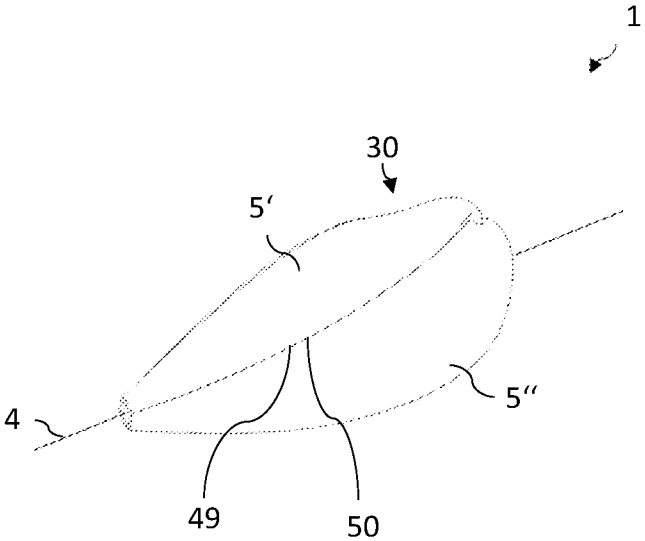

FIGS. 1A and 1B show the propeller 1 according to an example having the blades 5 closed. In particular, FIG. 1A shows the propeller 1 in an embodiment applied to a system with axis line 4, while FIG. 1B shows the propeller 1 in an embodiment applied to a pod system 52. In either case, the leading edge 49 of a first blade 5' is oscillating with the trailing edge 50 of a second blade 5" subsequent to the first blade 5'. A continuous solid in the shape of a spindle 30 is thus determined (simply defined as "spindle") in which a continuous surface is formed between the first blade 5' and the second blade 5", i.e. a surface without interruption points and without ridges. The continuous solid that is determined when the blades 5 are in the closed position has the shape of a "bud" or a solid having a bulge at the centre and a thinning at the ends. One end is thinner than the other. In particular, the outermost end, i.e. the one opposite for example the pod-like system 52 of FIG. 1B, is thinner so as to form a pointed structure. In this configuration, the propeller 1 has a coefficient of resistance and a front surface the product of which is minimal compared to a standard folding or rotatable blade propeller. Furthermore, given the continuity of the surface of the spindle 30, no turbulence is caused and the flow along the appendages of the boat is not disturbed.

When closed in this configuration, even blades 5 long enough to satisfy conditions 1-3 mentioned above satisfy condition 4 and do not cause excessive friction for sailing.

Specifically, this closing configuration allows the friction of the propeller 1 to be minimised regardless of the length of the blade 5 and the extent of the twist angle from the root to the apex. This configuration is particularly suitable for closing blades 5 with significant elongation as the spindle 30 obtained has a more hydrodynamic shape than that obtained by closing blades with less elongation. It is noted that the length of the blades 5 is one of the requirements for having a high efficiency of the propeller 1. It is in fact known that the efficiency of the propeller 1 is in inverse correlation with the ratio between the expanded area of the blades 5 and the area of the disc of the propeller 1. Expanded area means an area consisting of a number of straight segments equivalent to the number of blade sections 5 taken into account. These lines show the chords of the different sections 34 of the blade 5 itself and are drawn perpendicular to the axis indicating its radial position. Their ends are joined by a curve, which completes the graph. Approximately, the expanded area equals the area of one face of the blade 5 times the number of blades 5. The area of the disc means the surface swept by the blades 5, i.e. the surface of the disc with the radius of the propeller 1 minus that of the disc with the radius of the hub. According to one example, the ratio of the expanded area to the area of the disc of the propeller 1 is 23%. In the propellers known in the literature this ratio is on average 40%.

When the propeller 1 is in the closing position (and is not moving), the inner faces of the blades 5 are subject to a natural anti-fouling action by being in shadow and in contact with stagnant and poorly oxygenated water. On the external faces, every inspection and cleaning intervention is facilitated by the geometry of the completely connected surface. This makes it possible to quickly clean the propeller 1 by soaking in water for a few seconds. The arrangement of the blades 5 in the folding propellers or adjustable propellers known in the literature does not allow such quick cleaning. It is known that the cleanliness of the propeller 1 is one of the important factors to keep its performance high.

According to one example, in the transition from the opening to the closed position and vice versa, the blade 5 is configured to rotate around a rotation axis 8 of the blade 5 forming an angle $\alpha$ with the central axis of rotation 4 of the propeller 1, wherein said angle $\alpha$ is different from 90 degrees, and wherein in particular the angle $\alpha$ is between 20 degrees and 60 degrees.

Figure 2A:
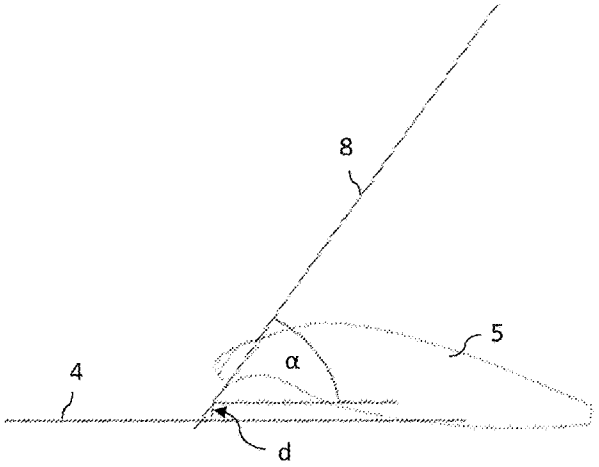
FIG. 2A-C show in a schematic representation the movement of a blade from a closed position to an open position according to one example.
Figure 2B:
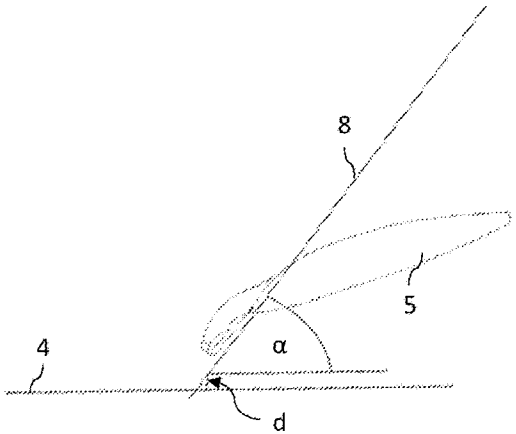
Figure 2C:
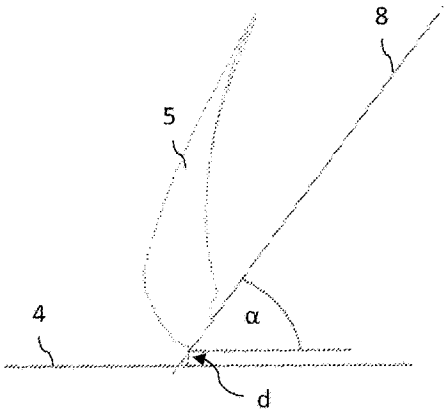

In particular, each blade 5 of the propeller 1 is constrained to the hub through an axis 8 that is non-perpendicular, non-parallel and non-secant with respect to the central axis 4 of the propeller 1. As shown in FIGS. 2A-2C, by rotating around such an axis 8 each blade 5 passes from the closed position (FIG. 2A) to that of opening or working position (FIG. 2C). The angle $\alpha$ that this axis 8 forms with respect to the central axis 4 of the propeller 1 as well as the distance d between them are determined by the geometry of the propeller 1 through a dedicated realization process that will be described below. The angle $\alpha$ and the distance d vary as a function of the geometry of the propeller 1 and the position of the opening fulcrum 53 relative to the blade 5 (shown in FIG. 3A). The distance d between the opening axis 8 of the blades 5 and axis 4 of the propeller 1 is evaluated as a percentage with respect to the radius of the hub. In general, the specifications of the embodiments listed below will be expressed in scale invariant terms, i.e. angles or aspect ratios.

Figure 3B:
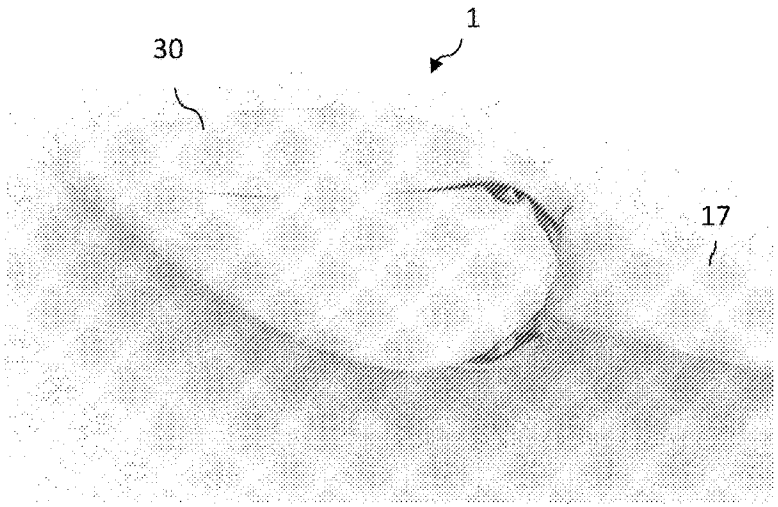
FIG. 3A-B a representation of a propeller with the blades in an open and closed position according to one example.
Figure 3A:
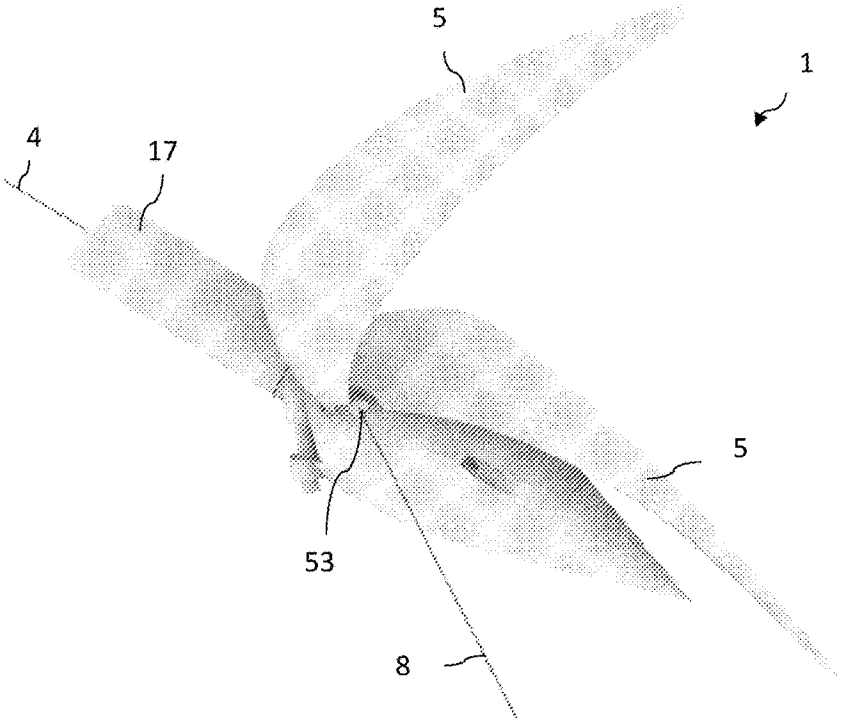

In a first embodiment shown in FIG. 3A, the opening fulcrum 53 is positioned at the rear end of the root profile chord of the blade 5. The resulting angle $\alpha$ is between 45° and 65°, in particular 51°. The resulting distance d is between 25% and 70% of the hub radius, in particular 28% of the hub radius. This configuration is useful for making, for example, a propeller 1 suitable for use with an axis line transmission. The position of the opening axis 8 allows it to be connected to the root of the blade 5 by means of a curved surface that "closes" the spindle 30 formed by the blades 5 in front (FIG. 3B).

Figure 4B:
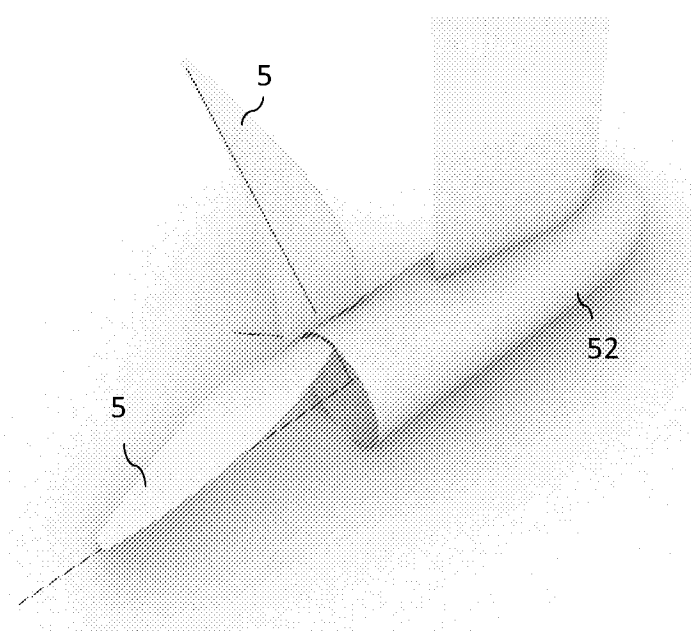
FIG. 4A-B a representation of a propeller with the blades in an open and closed position according to another example.
Figure 4A:
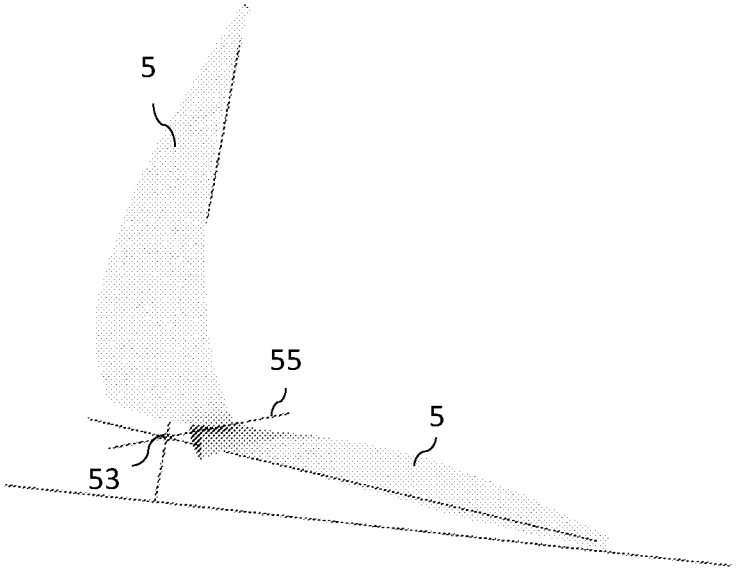

In a second embodiment shown in FIG. 4A, the opening fulcrum 53 is positioned on an extension of an axis 55 passing through the midpoint of the root and apex chords of the blade 5. The resulting angle $\alpha$ is between 45° and 65°, in particular 61.5°. The resulting distance d is between 25% and 70% of the hub radius, in particular 66% of the hub radius. Such a configuration is useful for realizing a propeller 1 suitable for use with a direct transmission in which the propeller 1 is connected to the torpedo housing the engine (FIG. 4B).

Depending on the geometry chosen and the final position to be obtained, the blade 5 can rotate from the closed position to the open position for an opening angle between 80° and 130°.

Figure 5B:
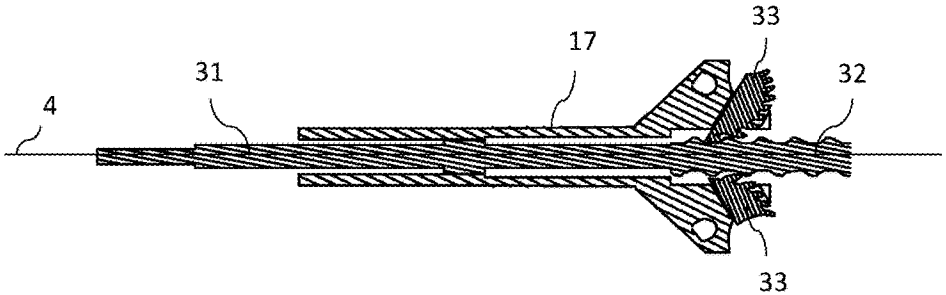
FIG. 5A-B show a diagrammatic representation of the gear used for movement of the blades according to one example, and the corresponding longitudinal section.
Figure 5A:
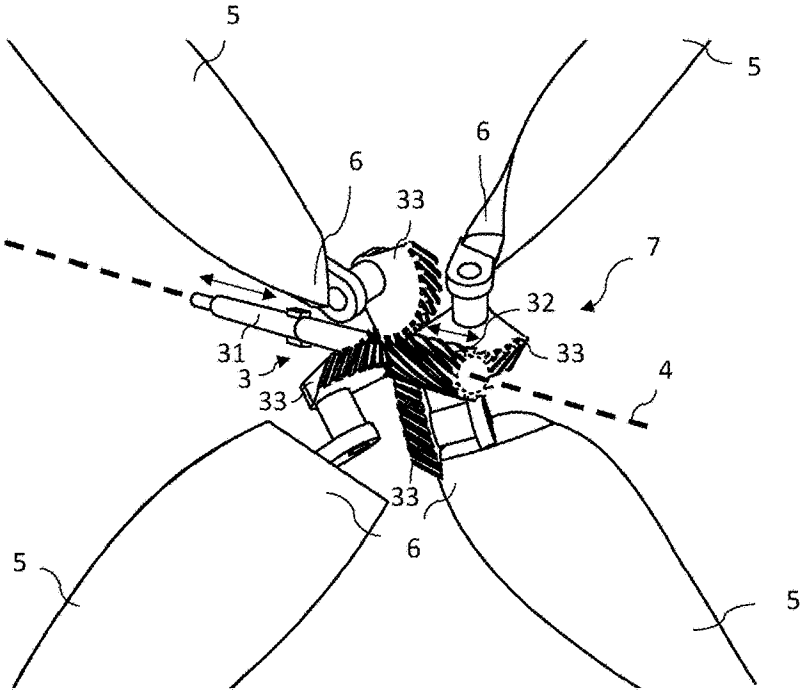

FIG. 5A shows a first example of propeller 1 in the opening configuration. The propeller 1 comprises a plurality of blades 5 (for example four) and a movement mechanism 3 rotatable around the central rotation axis 4 of the propeller 1. Each blade 5 of the plurality of blades 5 forming the propeller 1 comprises a root end 6 connected to the movement mechanism 3 by means of a gear 7 to allow the movement of the blade 5 from the open to the closed position and vice versa. By movement mechanism is meant a set of components (rods, wheels, connectors, etc.) that transfers the movement, for example of a motor, to the blades 5. The gear 7 comprises a central rod 31 provided with a longitudinal portion with spiral teeth 32 and a plurality of sections of toothed wheels 33, each one fixable to the root end 6 of the blade 5 and rotatable around the rotation axis 8 of the blade 5. The central rod 31 extends along the central rotation axis 4 of the propeller 1 and is couplable to the movement mechanism 3 and to each of the sections of toothed wheels 33.

According to one example, in the transition from the open position to the closed position and vice versa, the central rod 31 is configured to translate along the central rotation axis 4 of the propeller 1 and to rotate together with a hub 17.

As shown in FIG. 5A and in the longitudinal section of FIG. 5B, the primitive hyperboloid section of the central wheel of the gear 7 can be approximated by a cylinder. The portion with spiral teeth 32 develops on the cylinder for a length equal to that of the arc of circumference affected by the movement of the wheel 33 integral with the blade 5 multiplied by the transmission ratio or the ratio between the diameter of the wheel 33 integral with the blade 5 and the diameter of the central rod 31, in the case of the embodiment shown in the Figure this ratio is 3:1. The cylinder is constrained to rotate together with the hub and, by moving axially, simulates and replaces the circular motion of a central wheel. This solution simplifies the mechanics and is suitable for the construction of small propellers.

According to one embodiment the central cylinder can be replaced by a prism having as many faces as there are blades and wheels integral therewith, the teeth on the faces of said prism having the same inclination with respect to the axis of the spiral teeth on the cylinder/rod as in the previous example.

In this case, the gear-generating surfaces have a simpler shape that makes the construction of the teeth easier and cheaper.

The translation of the screw or central rod 31 is actuated by a drive integral with the motor and axially constrained to the screw through thrust bearings.

The opening/closing mechanism, given the angle chosen for the spiral on the central rod 31 of about 20°, is irreversible due to mechanical friction, therefore during normal use of the propeller 1, the stresses on the blades 5 are not transmitted to the drive, thus allowing the energy consumption to be limited to the adjustment phase only and the mechanical wear of the drive to be minimized. This feature applies to smaller and even larger angles up to about 30°. The angle chosen for the central rod 31 means the angle that the spiral on the rod 31 forms with respect to its translation axis.

A feedback system allows the position of the blades 5 and the pressure on them to be measured. The position may be recorded by an electronic feedback that measures the linear displacement of the axis of the opening drive. The pressure acting on the blade 5 is evaluated indirectly through the measurement of the absorption of the electric motor. During the opening/closing of the blades, the control electronics adjust the revolutions of the propeller 1 so as to minimize the load on the blades 5 so that they can move easily with respect to the hub.

Figure 6:
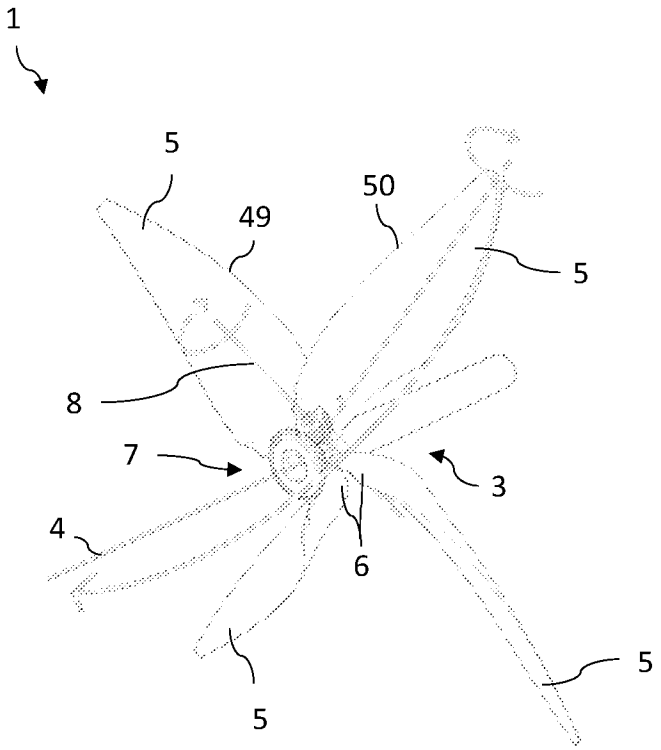
FIG. 6 shows a schematic representation of an open-bladed propeller according to another example.
Figure 7B:
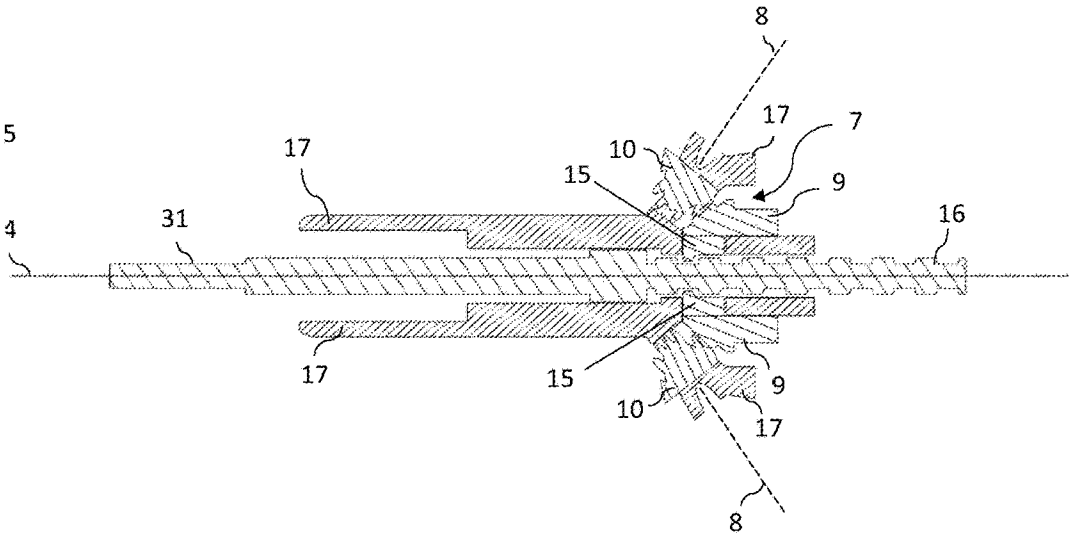
FIG. 7A-B show a diagrammatic representation of the gear used for movement of the blades according to FIG. 6, and the corresponding longitudinal section.
Figure 7A:
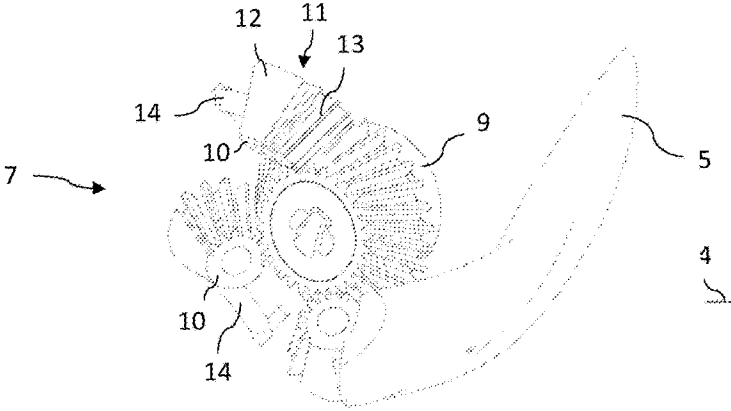

FIGS. 6, 7A and 7B show a second example of propeller 1 in the opening configuration (FIG. 6) with a different type of gear 7 for movement of the blades 5 (FIGS. 7A and 7B). Also in this case, the propeller 1 comprises a plurality of blades 5 (for example four) and a movement mechanism 3 rotatable around the central rotation axis 4 of the propeller 1. Each blade 5 of the plurality of blades 5 forming the propeller 1 comprises a root end 6 connected to the movement mechanism 3 by means of a gear 7 to allow the movement of the blade 5 from the open to the closed position and vice versa. As shown in FIG. 6, the rotation axis 8 of the blades 5 has a component parallel to the axis thereof. Therefore, through the movement and feedback mechanism 3 of the blades 5 it is possible to adjust the pitch of the propeller 1. This increases the speed range and the sailing conditions in which the propeller 1 maintains a high efficiency. For example, in an embodiment where the propeller 1 has a diameter of about 560 mm, a pitch of 530 mm corresponds to a rotation angle of the blade 5 on the opening axis 8 with respect to the closed position of 100°. On the other hand, a pitch of 840 mm corresponds to a rotation angle of the blade 5 on the opening axis 8 with respect to the closed position of 122°. Note that the known propellers with folding blades do not have the option of adjusting the pitch continuously during sailing. The known variable pitch propellers do not have the option of folding down the blades. By means of the propeller 1 described here, not only is it possible to adjust both the pitch and close the blades 5, but it can be done with a single mechanism, so there is a considerable advantage without unduly complicating the mechanics of the propeller 1.

In one example, the gear 7 is a bevel gear formed by a central wheel 9 fixable to the movement mechanism 3 and rotatable around the central rotation axis 4 of the propeller 1 and a plurality of secondary wheels 10, each fixable to the root end 6 of a blade 5 and rotatable around the rotation axis 8 of the blade 5. In one example, the central wheel 9 can be axially constrained to the hub 17. For example, the central wheel 9 may be constrained to the hub 17 by bearings, then may rotate relative to the hub 17 and share the rotation axis 4 and may not move axially. The connection between the central wheel 9 and the movement mechanism 3 takes place through the rapid-pitch screw 16 (integral with a central rod 31) and the nut screw 15 (integral with the central wheel 9), as explained below. As shown in FIG. 7A, the secondary wheel 10 comprises a crown 11 consisting of a smooth portion 12 and a toothed portion 13, wherein the smooth portion 12 comprises a pin 14 for the connection of the blade 5, in particular for the co-molding of said blade, and the toothed portion 13 is in contact with the central wheel 9. The toothed portion 13 is limited to the extent necessary to cover the angle $\alpha$.

As shown in FIG. 7B, the movement mechanism 3 comprises a nut screw 15 and a rapid-pitch screw 16, in which the nut screw 15 is integral to the gear 7, in particular to the central wheel 9, and is coupled to said rapid-pitch screw 16. The nut screw 15 and the rapid-pitch screw 16 are coaxial with the central rotation axis 4 of the propeller 1. In particular, the rapid-pitch screw 16 is constrained to rotate together with a hub 17 and is axially translatable with respect to said hub 17 such as to cause a rotation of the central wheel 9 with respect to the hub 17.

The opening of the blades 5 is synchronized by the series of bevel gears constituted by the common central wheel 9 and the secondary wheel 10 for each blade 5. Each secondary wheel 10 is integral with the driving blade 5 and together they are constrained to rotate about the rotation axis 8 of the blade 5 with respect to the hub 17 of the propeller 1. According to this second example, the central wheel 9 is constrained to rotate with respect to the hub 17 around the central rotation axis 4 of the propeller 1. The central wheel 9 is integral with the nut screw 15 on which a rapid-pitch screw 16 is inserted. Said screw 16 is constrained to rotate around the central axis 4 of the propeller 1 together with the hub 17 but free to translate axially with respect to it. The translation of the screw 16 determines the rotation of the central wheel 9 with respect to the hub 17 and therefore the opening or closing of the blades 5.

The translation of the screw 16 or of the central rod 31 is carried out by a drive integral with the motor and axially constrained to the screw 16 through thrust bearings.

Note that any type of intermediate solution between the first and the second example mentioned above is possible. For example, it is possible to adjust the opening of the blades 5 of a propeller 1 with the geometry of the first example using the screw 16 and the nut screw 15 described in the second example to rotate the central gear 7.

Figure 8B:
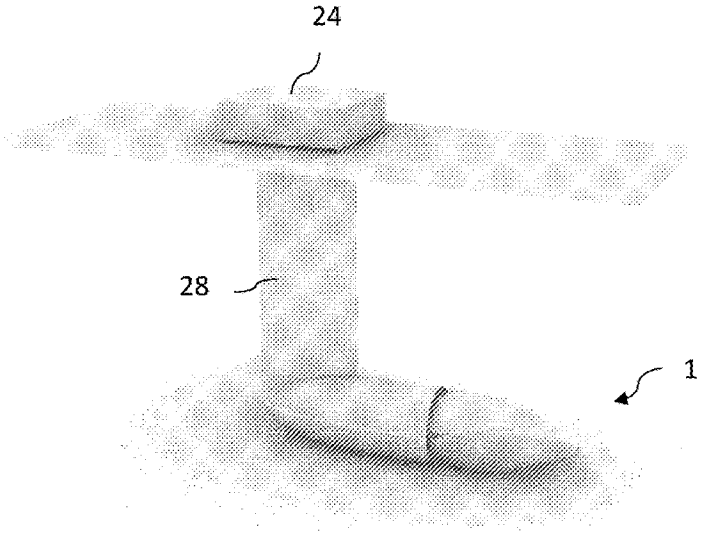
FIG. 8A-B show a block diagram and a schematic of a propulsion system according to one example.
Figure 8A:
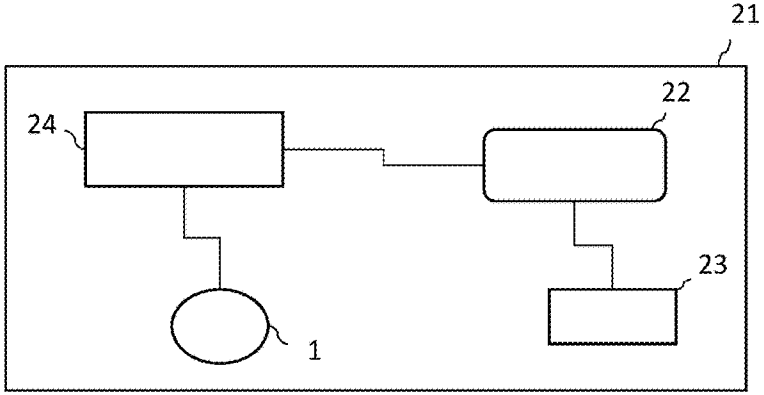

FIGS. 8A and 8B schematically show a propulsion system 21 couplable to a mobile vehicle 2. In particular, the system 21 comprises at least one electric motor 22, at least one accumulator of electrical energy 23 connected to the electric motor 22, at least one propeller 1 according to the examples described herein, and a control unit 24 connected to the electric motor 22 and to the propeller 1. A carbon fibre foot 28 adapted to adequately dissipate heat may be employed to connect the control unit 24 to the propeller 1.

Figure 9B:
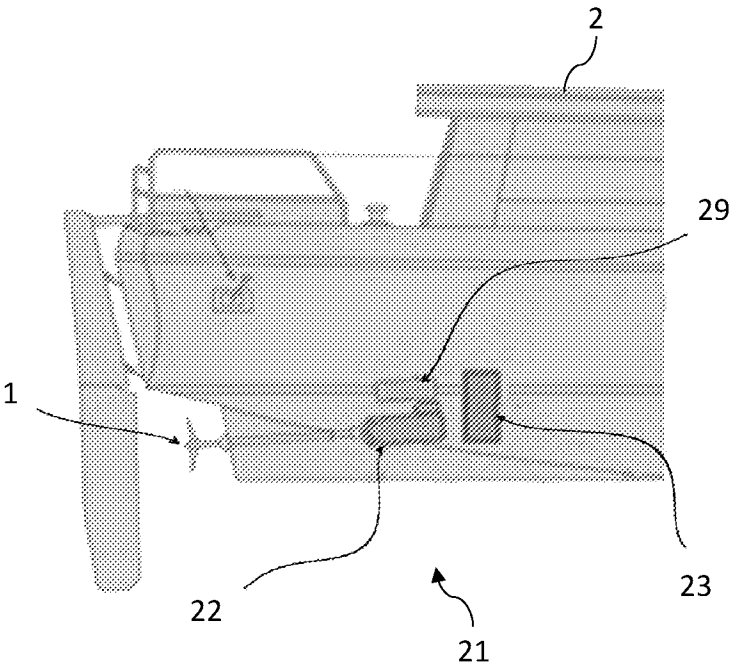
FIG. 9A-B show a schematic representation of a mobile vehicle, in particular a boat, employing the system and propeller according to one example.
Figure 9A:
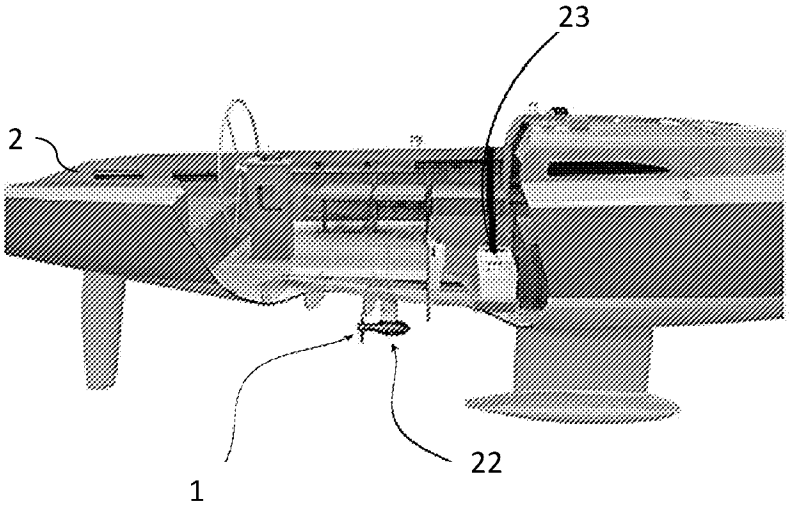

FIGS. 9A and 9B show a mobile vehicle 2 such as for example a sailboat comprising the propeller 1 or the propulsion system 21 described above. The mobile vehicle 2 may advantageously be a hybrid sailing/electric vehicle in which the propeller 1 is connected to a motor 22, to one or more electric energy accumulators 23 for storing the energy produced by the motion during sailing and to one or more inverters 29.

It should be noted that the high pitch and even the low recoil of an efficient and large diameter propeller 1 determine a low flow velocity with respect to the profile. In these conditions, a symmetrical profile of high thickness, greater than 20% of the chord, can therefore be used.

Figure 10C:
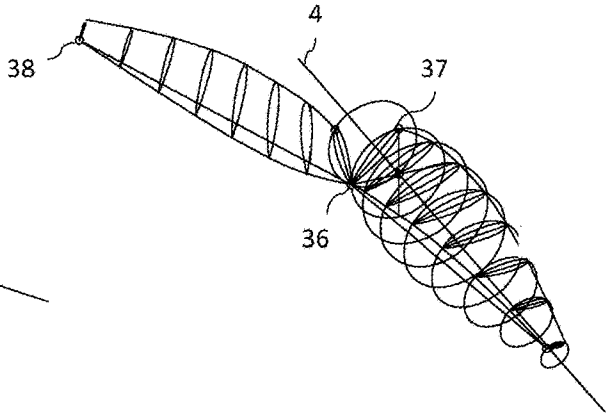
FIG. 10A-C show a schematic representation of the profile of a blade and method steps for realizing and defining the rotation axis of the blade according to one example.
Figure 10B:
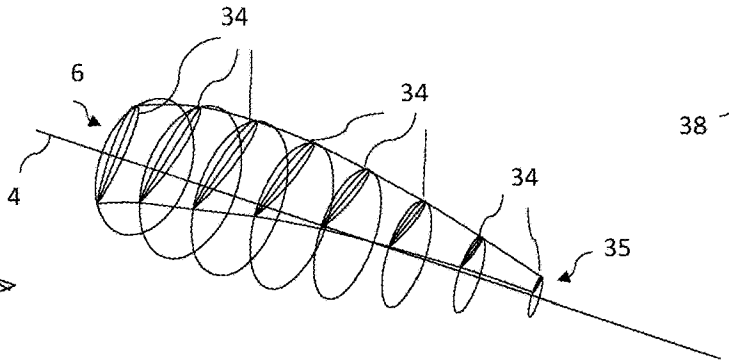
Figure 10A:
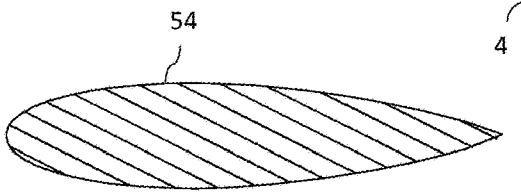

A profile of this kind is shown in FIG. 10A and has good efficiency over a wide range of incidence angles, both positive and negative. The propeller 1 is therefore perfectly symmetrical in the propulsion or regeneration phases and optimized for both. The transition from one phase to the other does not require mechanical and/or electronic mechanisms but depends exclusively on the ratio between the speed of the boat and the number of revolutions of the propeller 1 (any modern drive works in 4 quadrants and therefore automatically recovers energy when the torque is discordant with respect to the speed). Recharging efficiency does not require complex electronic or mechanical systems to manage the regeneration phase. In fact, given the geometry of the blades 5 as described herein, it is not necessary to finely adjust the number of revolutions of the propeller 1 to have satisfactory regeneration. The regeneration can then be activated automatically and instantaneously, for example, when the boat descends from an accelerating wave. This feature, closely related to the type of propeller 1 described here, has the advantage of stabilizing the sailing speed with obvious advantages for safety and comfort.

With the use of a high thickness profile 54 as in FIG. 10A there is also the advantage of being able to make the blades 5 with materials other than metal or with highly technological and expensive composites. With the available thickness, the blades 5 can easily be made of polymer for injection or 3D printing with economic advantages, and this provides propellers 1 specifically adapted to the characteristics of each individual boat to easily be made, as well as for co-molding together with the control gear.

In addition, the anti fouling agent adheres better to polymeric materials rather than to the metals from which most propellers are made. This is a critical factor in keeping the propeller 1 clean and therefore efficient for a long time.

Tests were carried out to demonstrate the effectiveness of the propeller described herein. During the propulsion phase of a propulsion system 21 as described herein, a total efficiency of 62% has been achieved, i.e. 62% of the energy drawn from the batteries is converted into effective work. The best known system in literature achieves a total efficiency of 54% using a fixed blade propeller. During the regenerative phase, the propulsion system 21 as described herein has a recharging efficiency at 6 knots equal to 16% of the nominal power. The best known system in the literature manages to recover 7% of the nominal power at 6 knots. It is obvious that such features make a sailing vessel equipped with a propulsion system 21 as described herein far more capable of achieving the objective of energy self-sufficiency than the examples of the known art.

To design a propeller 1 according to the present disclosure, a circular method is used for subsequent approximations, including using, for example, parametric CFD and CAD programs. Based on the efficiency requirements disclosed in the background, the basic parameters of the propeller are defined: diameter, pitch, expanded area, number of blades (greater than three, typically four). The diameter of the spindle portion 30 from which the blades 5 are intended to be obtained is determined in the first approximation by the expanded area and by the diameter of the propeller 1. In this phase, it is possible to approximate the surface of the spindle portion 30 from which the blades 5 are to be obtained by default with a cone and by excess with a truncated ellipsoid. In order to carry out such a calculation, the length of the spindle portion 30 from which the blades 5 are intended to be obtained is determined as a first approximation from the radius of the propeller 5 minus the estimated radius of the hub 17. To determine the opening fulcrum 53 on which to rotate the blades 5 from the closed position to the open position, it is necessary to evaluate the type of installation. If the propeller 1 is mounted on an axis line, the position of the opening fulcrum 53 is chosen to allow the root of the blade 5 to be connected by a curved surface that closes the spindle 30 formed by the blades 5 in front. If the propeller 1 is mounted on a pod/sail-drive 52, the position of the opening fulcrum 53 is chosen to allow the blade root 5 to open without interfering with the vessel housing the engine.

Once the fulcrum 53 is determined, the radius of the root of the blade 5 is obtained, the blade sections 5 are positioned on the spindle 30 starting from the root, each section has the vertices of the chord lying on the normal circular section of the spindle 30 corresponding to the blade section 34. The length of the chord corresponds to that of the side of the regular polygon inscribed in this section having a number of sides equal to the desired number of blades 5 (in the case of 4 blades $2r/\sqrt{2}$). Each chord is rotated to have the correct relative pitch setting angle with respect to the base chord (FIG. 10B).

Preferably, the geometric pitch setting angle for the various sections 34 is chosen to be used in the design of the blade 5. The pitch of each section 34 of the propeller 1 is lower than the geometric pitch when using the propeller 1 for propulsion and higher when using the propeller 1 in regeneration. In fact, the angle of geometric pitch setting minus the angle of incidence of the profile is determined (the angle of geometric pitch setting corresponds to the aerodynamic angle because a symmetric profile has been chosen). It can easily be deduced from geometric considerations that the resulting angle of attack is decreasing depending on the radius. In the second example described above, this apex angle is less than the root angle by about 2° in the propulsive phase and by about 1° in the regenerative phase.

It is known that one of the measures used to increase the performance of a propeller 1 is precisely to decrease the angle of attack towards the ends to decrease the apex vortices.

This is an advantage derived from the design choices allowed by the invention. Connecting the sections 34 will lead to the shape of the blade 5. The sections 34 at the root of the blade 5 may be modified to properly connect with the pod (torpedo) 52 when the propeller 1 is closed.

Specifically, the method of making a blade 5 of a propeller 1 as described herein comprises the following steps:

- determining the diameter of the propeller 1 and the chord pitch setting angles of the profiles for a predefined number of sections 34 of the blade 5 from the root end 6 to the apex end 35;
- determining the length of the portion of the spindle 30 from which the blades 5 are to be obtained by subtracting the radius of the section, on which the root end 6 of the blades 5 weigh, to the radius of the propeller 1, wherein the desired expanded area for the propeller 1 is approximately equal to the surface of the portion of the spindle 30 used to obtain the blades 5, wherein the diameter and in part the shape of the spindle 30 are determined by the measure of said surface;

positioning the blade sections 34 on the spindle 30 starting from the root end 6, wherein each section 34 has the vertices of the chord lying on the normal circular section of the spindle 30 corresponding to the section of the blade 5, wherein the length of the chord corresponds to that of the side of the regular polygon inscribed in this section having a number of sides equal to the desired number of blades 5 and wherein each chord is rotated to have the correct relative pitch setting angle with respect to the base chord; and obtaining the shape of the blade 5 by connecting the sections 34.

Figure 11A:
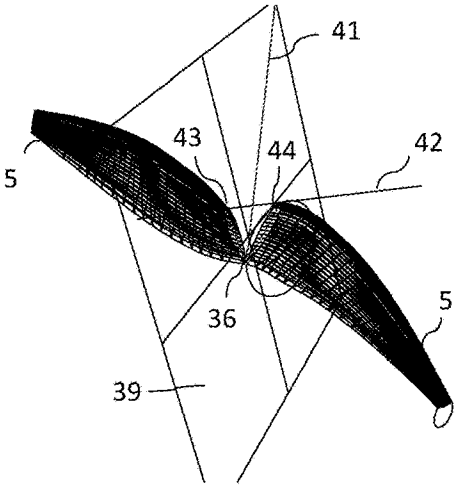
FIG. 11A-C show a schematic representation of the steps of the method for defining the blade rotation axis according to one example.
Figure 11B:
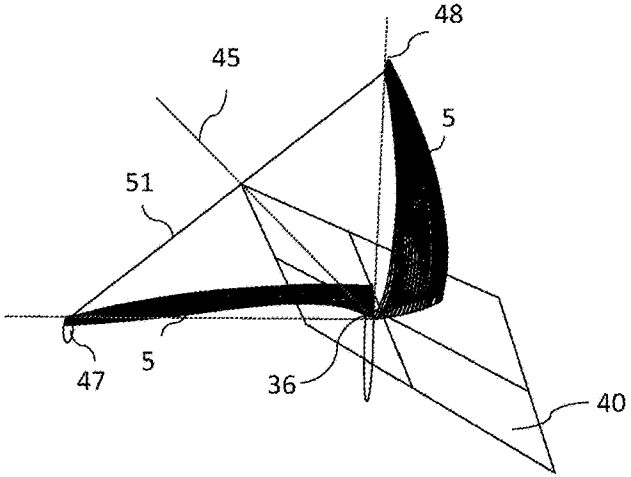
Figure 11C:
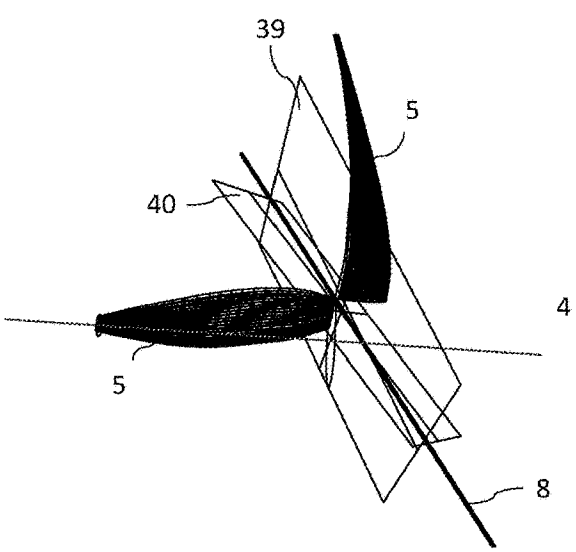
Figure 12:
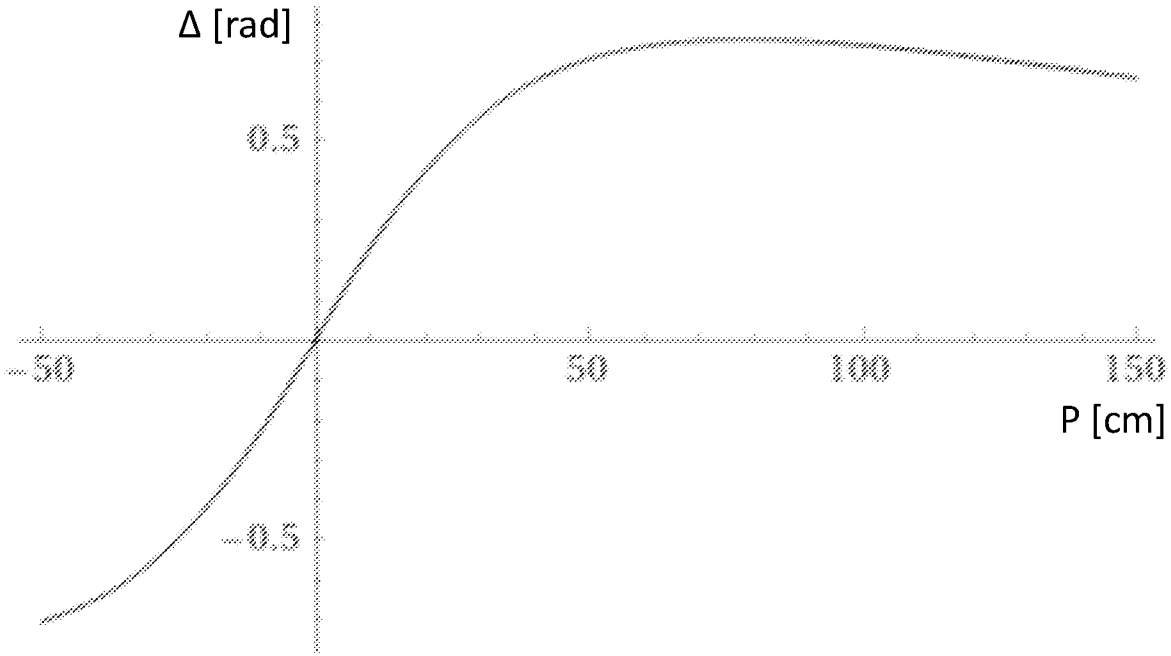
FIG. 12 shows a graph of the difference between the pitch setting angle at the apex and root of the blade as a function of the pitch of the propeller.

FIGS. 11A, 11B and 11C instead show the details of the method for defining the rotation axis 8 of the blade 5 of a propeller 1.

In particular, the method comprises the following steps:

positioning the blade 5 in the open position keeping fixed a first end 36, in particular the end point, of the root chord, the root chord being the chord at the root end 6;

positioning a second end 37 of said root chord equidistant with respect to the central rotation axis 4 of the propeller 1 and with the correct pitch setting, and positioning the vertex 38 at the apex end 35 of the blade 5 at the point of greatest distance with respect to the central rotation axis 4 of the propeller 1, wherein the rotation axis 8 of the blade 5 is determined by the intersection of a first plane 39 with a second plane 40, wherein the first plane 39 is a plane passing through a first bisector 41 relative to the angle whose vertex is the common terminal point 36 of the root chords and the sides are the lines on which the chords of the root sections lie in the opening and closed position, and perpendicular to a first straight line 42 passing through the first vertices 43, 44 of the two chords, and the second plane 40 is a plane passing through a second bisector 45 of the angle whose vertex is the terminal point 36 of the root chords and the sides are the lines passing through the second vertices 47, 48 of the blade 5 in the opening and closing position, and perpendicular to a second straight line 51 passing through the second vertices 47, 48 of the blade 5 in the opening and closed positions.

It should be noted that this method for defining the rotation axis 8 of the blade 5 of a propeller 1 has been described according to FIGS. 11A-11C in which the fulcrum 53 is on the end of the chord, as from FIG. 3A. It is of course evident that the same method is applicable for other configurations, as for example in the case where the fulcrum 53 is on the extension of the axis of the blade 5 as in FIG. 4A.

A person skilled in the art can perform several and further modifications and variants to the propeller, the system, the mobile vehicle and the method disclosed above, in order to satisfy further and contingent needs, all said modifications and variants being however included within the scope of protection of the present invention as defined by the appended claims.

The invention claimed is:

1. A propeller with folding blades for the propulsion of a mobile vehicle inside a fluid, the propeller comprising:

a movement mechanism rotatable around a central rotation axis of the propeller; and a plurality of blades, wherein each blade comprises a root end connected to the movement mechanism by means of a gear to allow the movement of said blade from an opening position to a closed position and vice versa, wherein in the closed position the plurality of blades is configured to form a continuous solid in the form of a spindle wherein a leading edge of a first blade is configured to osculate a trailing edge of a second blade following the first blade in such a way as to form a continuous surface between the first blade and the second blade, and wherein, in the transition from the opening to the closed position and vice versa, the blade is configured to rotate around a rotation axis of the blade forming an angle $\alpha$ with the central axis of rotation of the propeller, wherein said angle $\alpha$ is different from 90 degrees.

2. The propeller according to claim 1, wherein the gear comprises a central rod provided with a longitudinal portion with spiral teeth and a plurality of sections of toothed wheels, each one fixable to the root end of the blade and rotatable around the rotation axis of the blade, wherein the central rod extends along the central axis of rotation of the propeller and is coupable to the movement mechanism and to each of the sections of toothed wheels.

3. The propeller according to claim 2, wherein, in the passage from the opening to the closed position and vice versa, the central rod is configured to translate along the central axis of rotation of the propeller and to rotate together with a hub.

4. A method for defining the rotation axis of the blade of a propeller according to claim 2, the method comprising:

a. positioning the blade in the opening position keeping fixed a first end, terminal point of the root chord, the root chord being the chord at the root end;

b. placing a second end of this root chord equidistant with respect to the central axis of rotation of the propeller and with the correct pitch setting, and c. positioning the vertex at the apex end of the blade on the point of greatest distance from the central axis of rotation of the propeller, wherein the axis of rotation of the blade is determined by the intersection of a first plane with a second plane, wherein the first plane is a plane passing through a first bisector relative to the angle whose vertex is the common terminal point of the root chords and the sides are the lines on which the chords of the root sections lie in the opening and closed position, and perpendicular to a first straight line passing through the first vertices of the two chords, and the second plane is a plane passing through a second bisector of the angle whose vertex is the end point of the root chords and the sides are the lines passing through the second vertices of the blade in the opening and closing position, and perpendicular to a second straight line passing through the second vertices of the blade in the opening and closed positions.

5. The propeller according to claim 1, wherein the gear is a bevel gear formed by a central wheel fixable to the movement mechanism and rotatable around the central axis of rotation of the propeller and a plurality of secondary wheels, each of which fixable to the root end of a blade and rotatable about the axis of rotation of the blade.

6. The propeller according to claim 5, wherein the secondary wheel comprises a crown consisting of a smooth portion and a toothed portion, wherein the smooth portion comprises a pin for connecting the blade, in particular for the co-molding of said blade, and the toothed portion is in contact with the central wheel.

7. The propeller according to claim 5, wherein the movement mechanism comprises a nut screw and a rapid-pitch screw, in which the nut screw is integral with the central wheel, and is coupled to said rapid-pitch screw, the nut screw and the rapid-pitch screw being coaxial to the central rotation axis of the propeller, and wherein the rapid-pitch screw is constrained to rotate together with a hub and is axially translatable with respect to said hub such as to cause a rotation of the central wheel with respect to the hub.

8. The propeller according to claim 1, wherein the angle $\alpha$ is between 20 degrees and 60 degrees.

9. A propulsion system connectable to a mobile vehicle, the system comprising:

an electric motor;

an electrical energy accumulator connected to the electric motor;

at least one propeller according to claim 1, and a control unit connected to the electric motor and the propeller.

10. A mobile vehicle comprising a propeller according to claim 1.

11. A method for forming a blade of a propeller according to claim 1, wherein the propeller comprises a radius and a diameter when the blades are in the opening position and the blade comprises an apex end opposite the root end, the method comprising:

a. determining the diameter of the propeller and the pitch setting angles of the cords of the profiles for a predefined number of sections of the blade from the root end to the apex end;

b. determining the length of the portion of a solid in the form of a spindle from which the blades are to be obtained by subtracting the radius of the section, on which the root end of the blades weigh on, to the radius of the propeller, wherein the desired expanded area for the propeller is approximately equal to the surface of the portion of the solid in the form of a spindle used to obtain the blades, wherein the diameter and in part the shape of the solid in the form of a spindle are determined by the measure of said surface;

c. positioning the blade sections on the solid in the form of a spindle starting from the root end, wherein each section has the vertexes of the chord lying on the normal circular section of the solid in the form of a spindle corresponding to the blade section, wherein the length of the chord corresponds to that of the side of the regular polygon inscribed in this section having a number of sides equal to the desired number of blades and wherein each chord is rotated to have the correct relative pitch setting angle with respect to the base chord; and d. obtaining the shape of the blade by connecting the sections.

* * * * *